US010941661B2

(12) United States Patent
Yosuke et al.

(10) Patent No.: US 10,941,661 B2
(45) Date of Patent: Mar. 9, 2021

(54) SCROLL COMPRESSOR HAVING OLDHAM COUPLING WITH KEY PORTIONS PROJECTING FROM HORIZONTAL SURFACES INTO KEY GROOVES

(71) Applicant: DAIKIN INDUSTRIES, LTD., Osaka (JP)

(72) Inventors: Yoshinobu Yosuke, Osaka (JP); Takayuki Kawamoto, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 98 days.

(21) Appl. No.: 16/094,163

(22) PCT Filed: Apr. 17, 2017

(86) PCT No.: PCT/JP2017/015507
§ 371 (c)(1),
(2) Date: Oct. 16, 2018

(87) PCT Pub. No.: WO2017/183615
PCT Pub. Date: Oct. 26, 2017

(65) Prior Publication Data

US 2019/0136693 A1 May 9, 2019

(30) Foreign Application Priority Data

Apr. 18, 2016 (JP) ..... JP2016-082626

(51) Int. Cl.
*F01C 1/063* (2006.01)
*F03C 2/00* (2006.01)
(Continued)

(52) U.S. Cl.
CPC ..... *F01C 17/066* (2013.01); *F04C 18/02* (2013.01); *F04C 18/0215* (2013.01);
(Continued)

(58) Field of Classification Search
CPC .... F04C 18/02; F04C 18/0215; F04C 23/008; F04C 29/0057; F04C 2240/805;
(Continued)

(56) References Cited

U.S. PATENT DOCUMENTS 5,275,543 A * 1/1994 Tanaka ..... F01C 17/066 418/55.3
6,146,118 A 11/2000 Haller et al.
(Continued)

FOREIGN PATENT DOCUMENTS

CN 1715669 A 1/2006
EP 1 122 438 A2 8/2001
(Continued)

OTHER PUBLICATIONS

International Search Report of corresponding PCT Application No. PCT/JP2017/015507 dated Jun. 13, 2017.
(Continued)

*Primary Examiner* — Theresa Trieu
(74) *Attorney, Agent, or Firm* — Global IP Counselors, LLP

(57) ABSTRACT

A scroll compressor includes a movable scroll having first key grooves, a stationary member having second key grooves, and an Oldham coupling provided between the movable scroll and stationary member. The Oldham coupling is movable with respect to the stationary member along a first axis, and with respect to the movable scroll along a second axis. The Oldham coupling has an annular body portion, at least two first key portions fitted into the first grooves, and a pair of second key portions fitted into the second grooves. The first horizontal surface has inwardly positioned surfaces positioned more on a center of gravity side of the Oldham coupling than virtual extension lines of first inner peripheral edges that are part of an inner periph-
(Continued)

eral edge of the annular body portion. The first key portions have inwardly positioned portions that project from the inwardly positioned surfaces.

12 Claims, 13 Drawing Sheets

(51) Int. Cl.

| | |
|---|---|
| ***F03C 4/00*** | (2006.01) |
| ***F04C 18/00*** | (2006.01) |
| ***F01C 17/06*** | (2006.01) |
| ***F04C 18/02*** | (2006.01) |
| ***F04C 29/00*** | (2006.01) |

(52) U.S. Cl.
CPC .... *F04C 29/0057* (2013.01); *F04C 2240/805* (2013.01); *F05B 2230/60* (2013.01)

(58) Field of Classification Search
CPC .... F05B 2230/60; F01C 17/06; F01C 17/066; F16D 3/04
USPC ..... 418/55.1–55.6, 57; 464/102, 104–105
See application file for complete search history.

(56) References Cited

U.S. PATENT DOCUMENTS

| | | | | |
|---|---|---|---|---|
| 6,443,719 | B1 * | 9/2002 | Fenocchi | F01C 17/066 418/55.3 |
| 6,776,593 | B1 * | 8/2004 | Cho | F01C 17/066 418/55.3 |
| 2013/0251544 | A1 * | 9/2013 | Duppert | F01C 21/10 417/53 |

FOREIGN PATENT DOCUMENTS

| | | | | | |
|---|---|---|---|---|---|
| JP | 06249163 | A | * | 9/1994 | F01C 17/066 |
| JP | 2003239875 | A | * | 8/2003 | F01C 17/066 |
| JP | 2005-264931 | A | | 9/2005 | |
| JP | 2011-510209 | A | | 3/2011 | |
| JP | 2014-29117 | A | | 2/2014 | |

OTHER PUBLICATIONS

International Preliminary Report of corresponding PCT Application No. PCT/JP2017/015507 dated Nov. 1, 2018.
European Search Report of corresponding EP Application No. 17 78 5953.5 dated Mar. 15, 2019.

* cited by examiner

SCROLL COMPRESSOR HAVING OLDHAM COUPLING WITH KEY PORTIONS PROJECTING FROM HORIZONTAL SURFACES INTO KEY GROOVES

CROSS-REFERENCE TO RELATED APPLICATIONS

This U.S. National stage application claims priority under 35 U.S.C. § 119(a) to Japanese Patent Application No. 2016-082626, filed in Japan on Apr. 18, 2016, the entire contents of which are hereby incorporated herein by reference.

TECHNICAL FIELD

The present invention relates to a scroll compressor equipped with an Oldham coupling for preventing self-rotation of a movable scroll.

BACKGROUND ART

A scroll compressor used in a refrigeration system or the like is equipped with a fixed scroll and a movable scroll. The fixed scroll and the movable scroll each have a spiral portion. The spiral portion of the movable scroll interfits with the spiral portion of the fixed scroll, whereby compression chambers, which are spaces in which a fluid such as refrigerant gas is compressed, are formed. The scroll compressor compresses the fluid by causing the movable scroll to orbit to change the volumes of the compression chambers.

Ordinarily the scroll compressor is equipped with an Oldham coupling for preventing self-rotation of the movable scroll during operation. The Oldham coupling is installed between the movable scroll and a fixed member such as a housing. As disclosed in JP-A No. 2011-510209, the Oldham coupling has an annular body portion and key portions that project in the vertical direction from the body portion. Each key portion has a surface that slides against the movable scroll or the fixed member.

SUMMARY

In the case of an Oldham coupling such as disclosed in JP-A No. 2011-510209, the sliding lengths, which are the lengths of the sliding surfaces of the key portions along the sliding direction of the key portions, are constrained by the dimensions of the annular body portion. Specifically, it is necessary to shorten the sliding lengths of the key portions the shorter the difference is between the outer diameter and the inner diameter of the annular body portion. However, if the sliding lengths of the key portions are not sufficient, the surface pressure that acts on the sliding surfaces of the key portions becomes higher. Because of this, there is the concern that issues such as seizure of the sliding surfaces and damage to the key portions will arise, thereby reducing the reliability of the compressor.

It is an object of the present invention to provide a scroll compressor that has high reliability by sufficiently ensuring the sliding lengths of the key portions of the Oldham coupling.

A scroll compressor pertaining to a first aspect of the invention is equipped with a movable scroll, a stationary member, and an Oldham coupling. The movable scroll has first key grooves. The stationary member has second key grooves. The Oldham coupling is provided between the movable scroll and the stationary member. The Oldham coupling is relatively movable with respect to the stationary member along a first axis and is relatively movable with respect to the movable scroll along a second axis. The Oldham coupling has an annular body portion, two pairs of first key portions, and a pair of second key portions. The annular body portion has a first horizontal surface and a second horizontal surface that oppose each other. The first key portions project from the first horizontal surface and are fitted into the first key grooves. The second key portions project from the second horizontal surface and are fitted into the second key grooves. The first key portions are provided one each in four regions partitioned by the first axis and the second axis. The second key portions are provided on the first axis across the second axis. First inner peripheral edges, which are inner peripheral edges of the annular body portion between the two first key portions located on the same sides with respect to the first axis, have circular arc shapes. The first horizontal surface has inwardly positioned surfaces that are positioned more on a center of gravity side of the Oldham coupling than virtual extension lines of the circular arcs of the first inner peripheral edges. The first key portions have inwardly positioned portions that project from the inwardly positioned surfaces.

In this scroll compressor, the first key portions of the Oldham coupling have sliding surfaces that slide against the movable scroll. The sliding length, which is the length of the sliding surfaces of the first key portions in the sliding direction of the first key portions, can be lengthened an amount corresponding to the inwardly positioned portions of the first key portions. Because of this, the sliding length of the first key portions can be sufficiently ensured, so the surface pressure that acts on the sliding surfaces of the first key portions can be restrained. Consequently, this scroll compressor has high reliability by sufficiently ensuring the sliding lengths of the key portions of the Oldham coupling.

A scroll compressor pertaining to a second aspect of the invention is the scroll compressor pertaining to the first aspect, wherein second inner peripheral edges, which are inner peripheral edges of the annular body portion between the two first key portions located on the same sides with respect to the second axis, have circular arc shapes. The first inner peripheral edges and the second inner peripheral edges are interconnected via step portions.

In this scroll compressor, the annular body portion of the Oldham coupling has the first inner peripheral edges and the second inner peripheral edges that have circular arc shapes with mutually different radii. The first inner peripheral edges and the second inner peripheral edges form step portions at the positions of the inwardly positioned portions of the first key portions. Because of the step portions, one of the first inner peripheral edges and the second inner peripheral edges can be formed more outward in the radial direction of the annular body portion than the other. Because of this, the radial direction dimension of the annular body portion can be shortened in the ranges of the first inner peripheral edges or the second inner peripheral edges, Consequently, with this scroll compressor, the weight of the Oldham coupling can be reduced.

A scroll compressor pertaining to a third aspect of the invention is the scroll compressor pertaining to the first aspect or the second aspect, wherein the radius of the circular arcs of the first inner peripheral edges is longer than the radius of the circular arcs of the second inner peripheral edges.

In this scroll compressor, the annular body portion of the Oldham coupling has the first inner peripheral edges and the second inner peripheral edges that have circular arc shapes with mutually different radii. The first inner peripheral edges can be formed more outward in the radial direction of the annular body portion than the second inner peripheral edges. Because of this, the radial direction dimension of the annular body portion can be shortened in the ranges of the first inner peripheral edges. Consequently, with this scroll compressor, the weight of the Oldham coupling can be reduced. Furthermore, the radial direction dimension of the annular body portion can be ensured in the ranges of the second inner peripheral edges, so the sliding length of the second key portions can be lengthened by that amount. Because of this, the surface pressure that acts on the sliding surfaces of the second key portions can be restrained.

A scroll compressor pertaining to a fourth aspect of the invention is the scroll compressor pertaining to any one of the first to third aspects, wherein the dimension of the first key portions along the second axis is longer than the dimension of the second key portions along the first axis.

In this scroll compressor, the sliding length of the first key portions can be made longer than the sliding length of the second key portions. Because of this, the surface pressure that acts on the sliding surfaces of the first key portions can be restrained.

Furthermore, the scroll compressor pertaining to the fifth aspect of the invention is equipped with a movable scroll, a stationary member, and an Oldham coupling. The movable scroll has first key grooves. The stationary member has second key grooves. The Oldham coupling is provided between the movable scroll and the stationary member. The Oldham coupling is relatively movable with respect to the stationary member along a first axis and is relatively movable with respect to the movable scroll along a second axis. The Oldham coupling has an annular body portion, at least two first key portions, and a pair of second key portions. The annular body portion has a first horizontal surface and a second horizontal surface that oppose each other. The first key portions project from the first horizontal surface and are fitted into the first key grooves. The second key portions project from the second horizontal surface and are fitted into the second key grooves. The first key portions are provided in any of four regions partitioned by the first axis and the second axis, and two or more of the first key portions are not provided in the same region. The second key portions are provided on the first axis across the second axis. The first horizontal surface has inwardly positioned surfaces that are positioned more on a center of gravity side of the Oldham coupling than virtual extension lines of first inner peripheral edges that are part of an inner peripheral edge of the annular body portion. The first key portions have inwardly positioned portions that project from the inwardly positioned surfaces.

The scroll compressor pertaining to the invention has high reliability by sufficiently ensuring the sliding lengths of the key portions of the Oldham coupling.

BRIEF DESCRIPTION OF DRAWINGS

FIG. 9 is an enlarged view of the area around a first key portion at the upper left of

FIG. 8.

DETAILED DESCRIPTION OF EMBODIMENTS

A scroll compressor 101 pertaining to an embodiment of the invention will be described with reference to the drawings. The scroll compressor 101 is used in a refrigeration system such as an air conditioning system. The scroll compressor 101 compresses refrigerant gas that circulates through a refrigerant circuit of the refrigeration system.

(1) Configuration of Scroll Compressor

The scroll compressor 101 is a high/low pressure dome-type scroll compressor. The scroll compressor 101 compresses refrigerant using two scroll members having spiral-shaped wraps that interfit.

Figure 1:
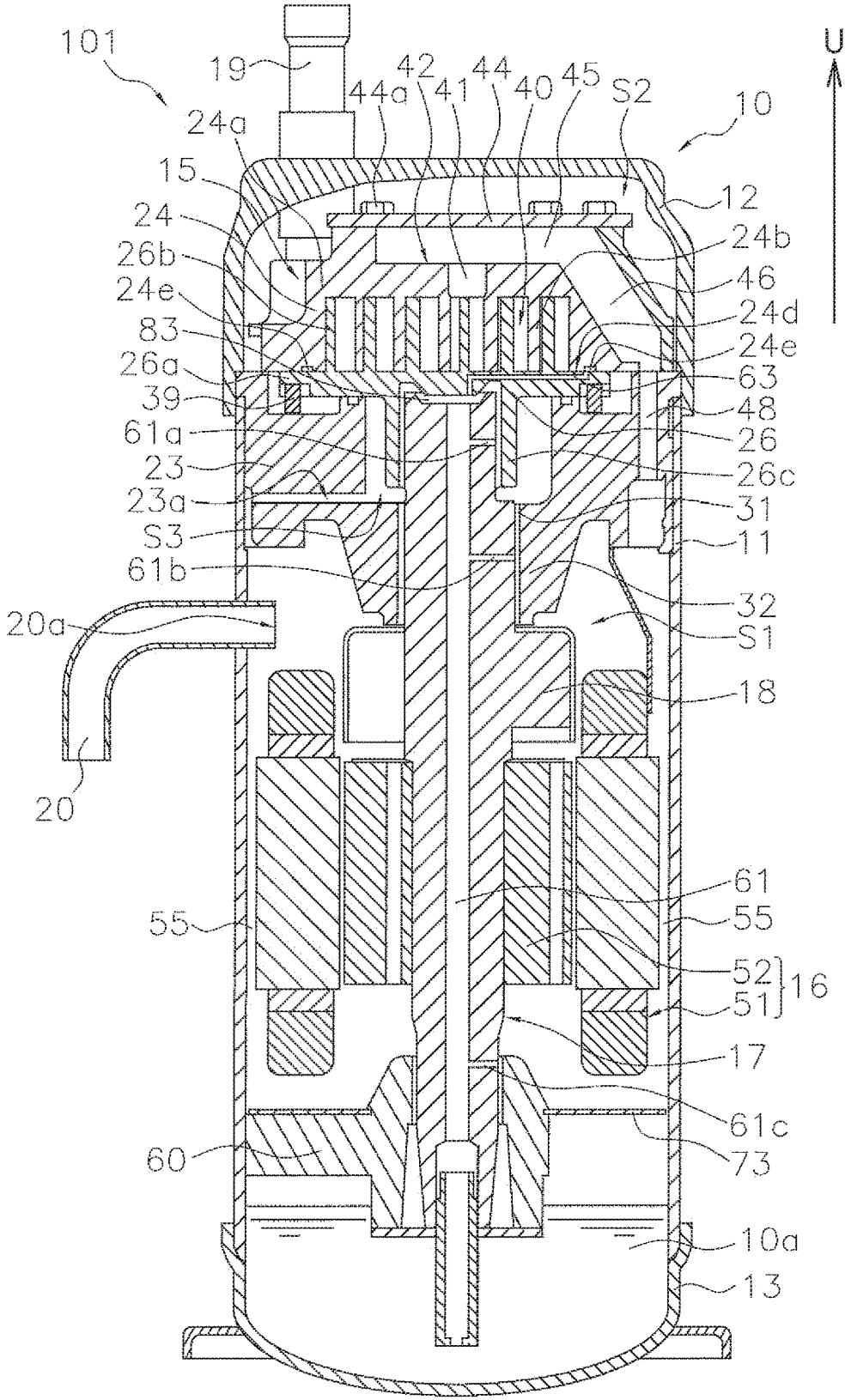
FIG. 1 is a longitudinal sectional view of a scroll compressor pertaining to an embodiment.

FIG. 1 is a longitudinal sectional view of the scroll compressor 101. In FIG. 1, arrow U indicates an upward direction along a vertical direction. The scroll compressor 101 is configured mainly from a casing 10, a compression mechanism 15, a housing 23, (one example of a stationary member), an Oldham coupling 39, a drive motor 16, a lower bearing 60, a crankshaft 17, a suction pipe 19, and a discharge pipe 20. Next, the constituent elements of the scroll compressor 101 will be described.

(1-1) Casing

The casing 10 is configured from an open cylinder-shaped barrel casing portion 11, a bowl-shaped top wall portion 12, and a bowl-shaped bottom wall portion 13. The top wall portion 12 is airtightly welded to the upper end portion of the barrel casing portion 11. The bottom wall portion 13 is airtightly welded to the lower end portion of the barrel casing portion 11.

The casing 10 is formed of a rigid member that does not easily become deformed or damaged when there is a change in pressure and/or temperature inside and outside the casing 10. The casing 10 is installed in such a way that the axial direction of the open cylindrical shape of the barrel casing portion 11 lies along the vertical direction.

Inside the casing 10 are housed mainly the compression mechanism 15, the housing 23, the Oldham coupling 39, the drive motor 16, the lower bearing 60, and the crankshaft 17. The suction pipe 19 and the discharge pipe 20 are airtightly welded to wall portions of the casing 10.

In the bottom portion of the casing 10 is formed an oil collection space 10*a* in which lubricating oil is stored. The lubricating oil is refrigerating machine oil that is used to well preserve the lubricity of sliding parts of the compression mechanism 15 and so forth during the operation of the scroll compressor 101.

(1-2) Compression Mechanism

Figure 2:
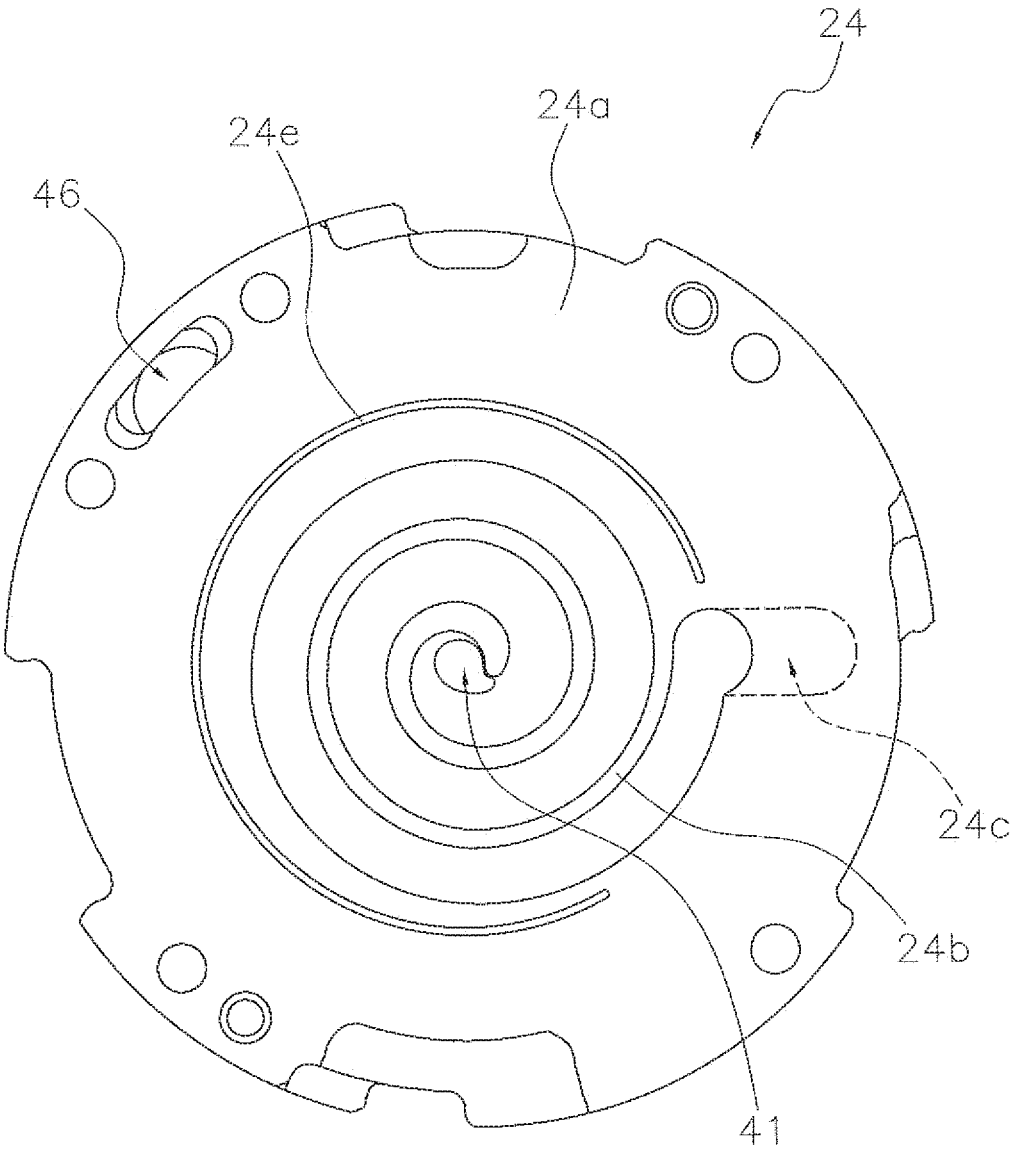
FIG. 2 is a bottom view of a fixed scroll.
Figure 3:
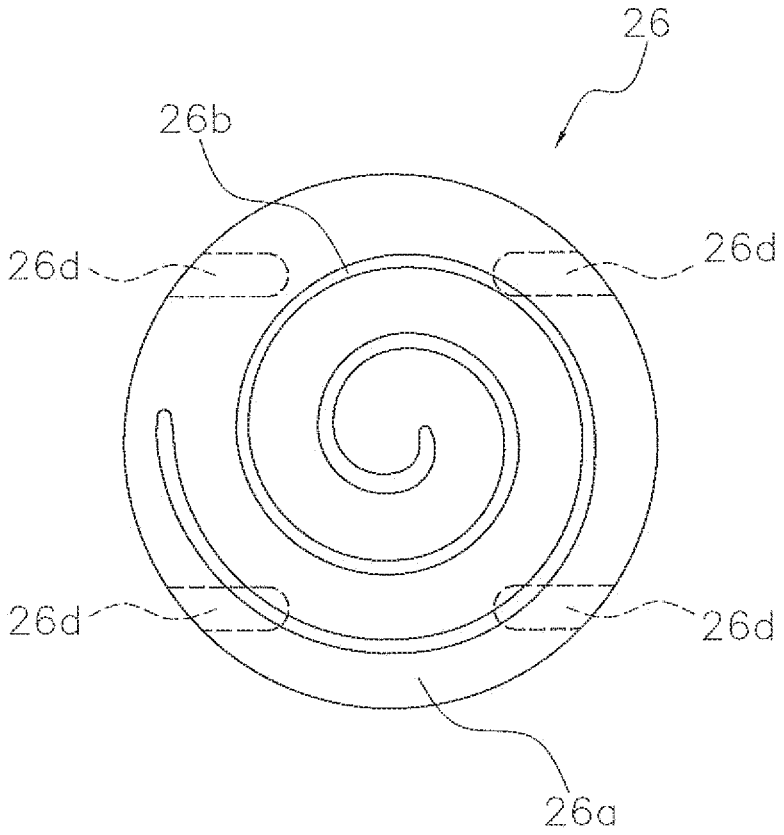
FIG. 3 is a top view of a movable scroll.

The compression mechanism 15 is housed inside the casing 10. The compression mechanism 15 sucks in and compresses low-temperature low-pressure refrigerant gas and discharges high-temperature high-pressure refrigerant gas (hereinafter called "compressed refrigerant"), The compression mechanism 15 is configured mainly from a fixed scroll 24 and a movable scroll 26. The fixed scroll 24 is fixed with respect to the casing 10. The movable scroll 26 performs orbiting movement with respect to the fixed scroll 24. FIG. 2 is a bottom view of the fixed scroll 24 as seen along the vertical direction. FIG. 3 is a top view of the movable scroll 26 as seen along the vertical direction.

(1-2-1) Fixed Scroll

The fixed scroll 24 has a first end plate 24*a* and a first wrap 24*b* that is spiral-shaped and formed upright on the first end plate 24*a*. A main suction hole 24*c* is formed in the first end plate 24*a*. The main suction hole 24*c* is a space that interconnects the suction pipe 19 and later-described compression chambers 40. The main suction hole 24*c* forms a suction space for introducing the low-temperature low-pressure refrigerant gas from the suction pipe 19 to the compression chambers 40. A discharge hole 41 is formed in the central portion of the first end plate 24*a*, and a broad recess portion 42 that communicates with the discharge hole 41 is formed in the upper surface of the first end plate 24*a*. The broad recess portion 42 is a space that is provided recessed in the upper surface of the first end plate 24*a*. A cover 44 is fixed by bolts 44*a* to the upper surface of the fixed scroll 24 in such a way as to close off the broad recessed portion 42. The fixed scroll 24 and the cover 44 are sealed via a gasket (not shown in the drawings). A muffler space 45 that muffles the operating sound of the compression mechanism 15 is formed as a result of the broad recessed portion 42 being covered with the cover 44. A first compressed refrigerant flow passage 46 that communicates with the muffler space 45 and opens to the lower surface of the fixed scroll 24 is formed in the fixed scroll 24. An oil groove 24*e* that is C-shaped as shown in FIG. 2 is formed in the lower surface of the first end plate 24*a*.

(1-2-2) Movable Scroll

The movable scroll 26 has a second end plate 26*a* that is disc-shaped and a second wrap 26*b* that is spiral-shaped and formed upright on the second end plate 26*a*. An upper end bearing 26*c* is formed in the central portion of the lower surface of the second end plate 26*a*. An oil feed pore 63 is formed in the movable scroll 26. The oil feed pore 63 allows the outer peripheral portion of the upper surface of the second end plate 26*a* and the space inside the upper end bearing 26*c* to communicate with each other.

Figure 4:
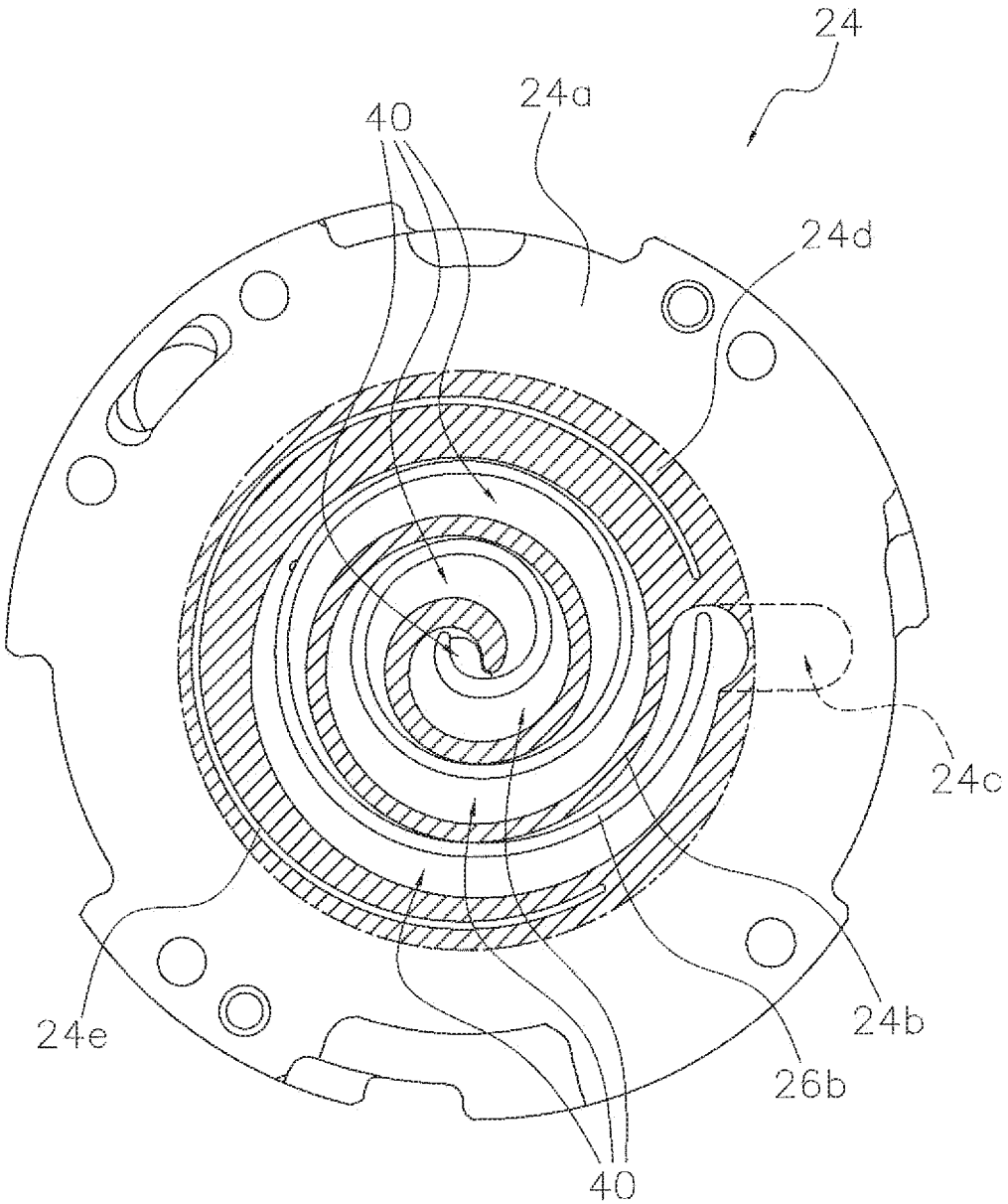
FIG. 4 is a bottom view of the fixed scroll in which a second wrap of the movable scroll and compression chambers are shown.

The fixed scroll 24 and the movable scroll 26 form, as a result of the first wrap 24*b* and the second wrap 26*b* interfitting, compression chambers 40 that are spaces enclosed by the first end plate 24*a*, the first wrap 24*b*, the second end plate 26*a*, and the second wrap 26*b*. The volumes of the compression chambers 40 are gradually reduced by the orbiting movement of the movable scroll 26. During the orbiting of the movable scroll 26, the lower surfaces of the first end plate 24*a* and the first wrap 24*b* of the fixed scroll 24 slide against the upper surfaces of the second end plate 26*a* and the second wrap 26*b* of the movable scroll 26. Hereinafter, the surface of the first end plate 24*a* that slides against the movable scroll 26 will be called a thrust sliding surface 24*d*. FIG. 4 is a bottom view of the fixed scroll 24 in which the second wrap 26*b* of the movable scroll 26 and the compression chambers 40 are shown. In FIG. 4, the region with the hatching represents the thrust sliding surface 24*d*. In FIG. 4, the outer edge of the thrust sliding surface 24*d* represents the path of the outer edge of the second end plate 26*a* of the orbiting movable scroll 26. As shown in FIG. 4, the oil groove 24*e* of the fixed scroll 24 is formed in the lower surface of the first end plate 24*a* in such a way as to fit within the thrust sliding surface 24*d*.

Two pairs of first key grooves 26*d* are formed in the lower surface of the second end plate 26*a*. In FIG. 3, the positions of the first key grooves 26*d* are indicated by dashed lines. When the movable scroll 26 is seen along the vertical direction, the first key grooves 26*d* are formed in positions the same distance away from the center of the second end plate 26*a*. The first key grooves 26*d* are grooves into which first key portions 39*b* of the Oldham coupling 39 are fitted.

(1-3) Housing

The housing 23 is disposed under the compression mechanism 15. The outer peripheral surface of the housing 23 is airtightly joined to the inner peripheral surface of the barrel casing portion 11. Because of this, the inside space of the casing 10 is partitioned into a high-pressure space S1 under the housing 23 and an upper space S2 that is a space above the housing 23. The housing 23 has the fixed scroll 24 mounted on it and, together with the fixed scroll 24, sandwiches the movable scroll 26. A second compressed refrigerant flow passage 48 is formed in, so as to run through in the vertical direction, the outer peripheral portion of the housing 23. The second compressed refrigerant flow passage 48 communicates with the first compressed refrigerant flow passage 46 at the upper surface of the housing 23 and communicates with the high-pressure space S1 at the lower surface of the housing 23.

A crank chamber S3 is provided recessed in the upper surface of the housing 23. A housing through hole 31 is formed in the housing 23. The housing through hole 31 runs through the housing 23 in the vertical direction from the central portion of the bottom surface of the crank chamber S3 to the central portion of the lower surface of the housing 23. Hereafter, the portion that is part of the housing 23 and in which the housing through hole 31 is formed will be called an upper bearing 32. in the housing 23 is formed an oil return passageway 23*a* that allows the high-pressure space S1 in the neighborhood of the inner surface of the casing 10 and the crank chamber S3 to communicate with each other.

A pair of second key grooves 23*d* is formed in the upper surface of the housing 23. When the housing 23 is seen along the vertical direction, the second key grooves 23*d* are formed in positions the same distance away from the center of the housing through hole 31.

The second key grooves 23*d* are grooves into which second key portions 39*c* of the Oldham coupling 39 are fitted.

(1-4) Oldham Coupling

Figure 5:
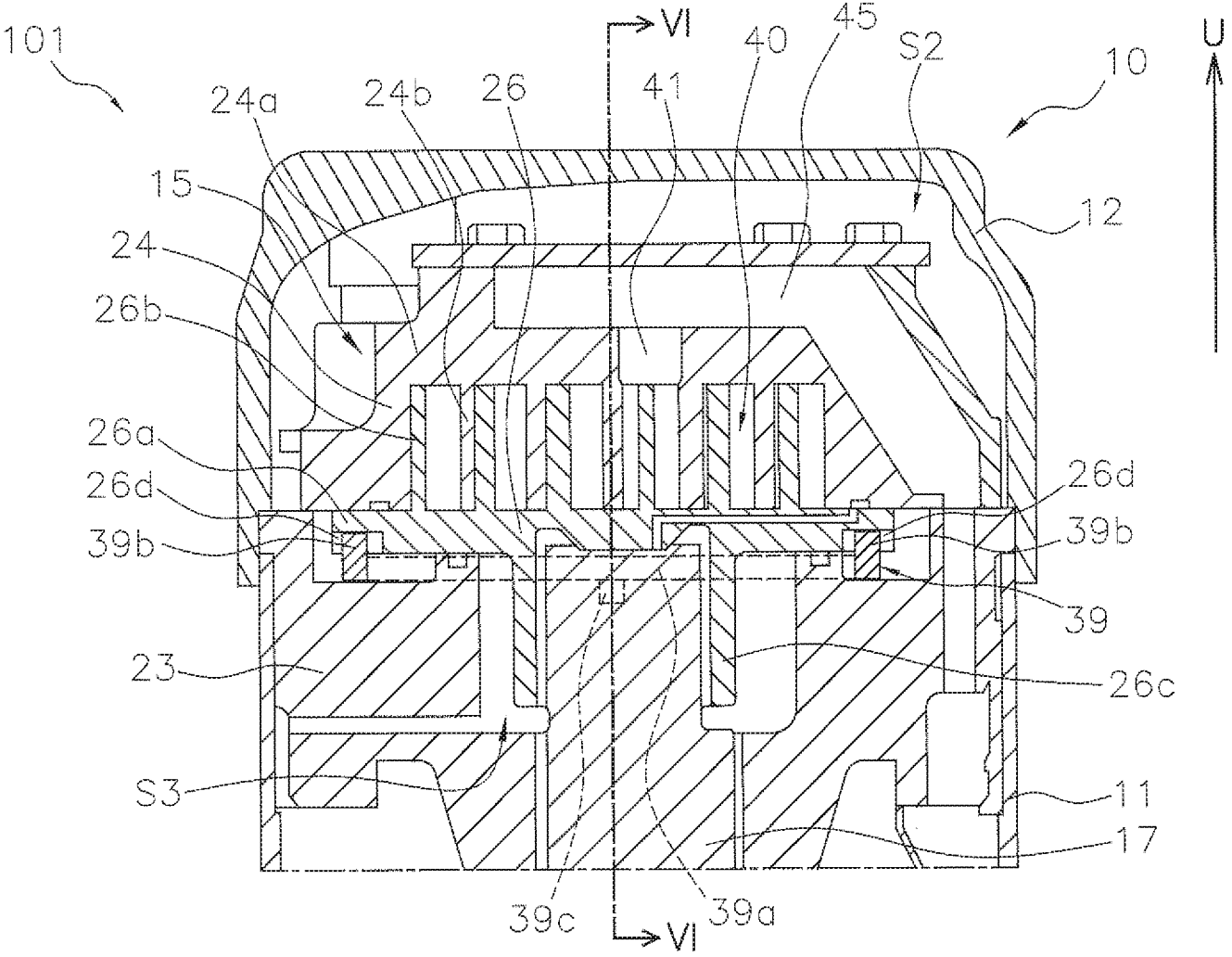
FIG. 5 is an enlarged view of the area around an Oldham coupling of FIG. 1.
Figure 6:
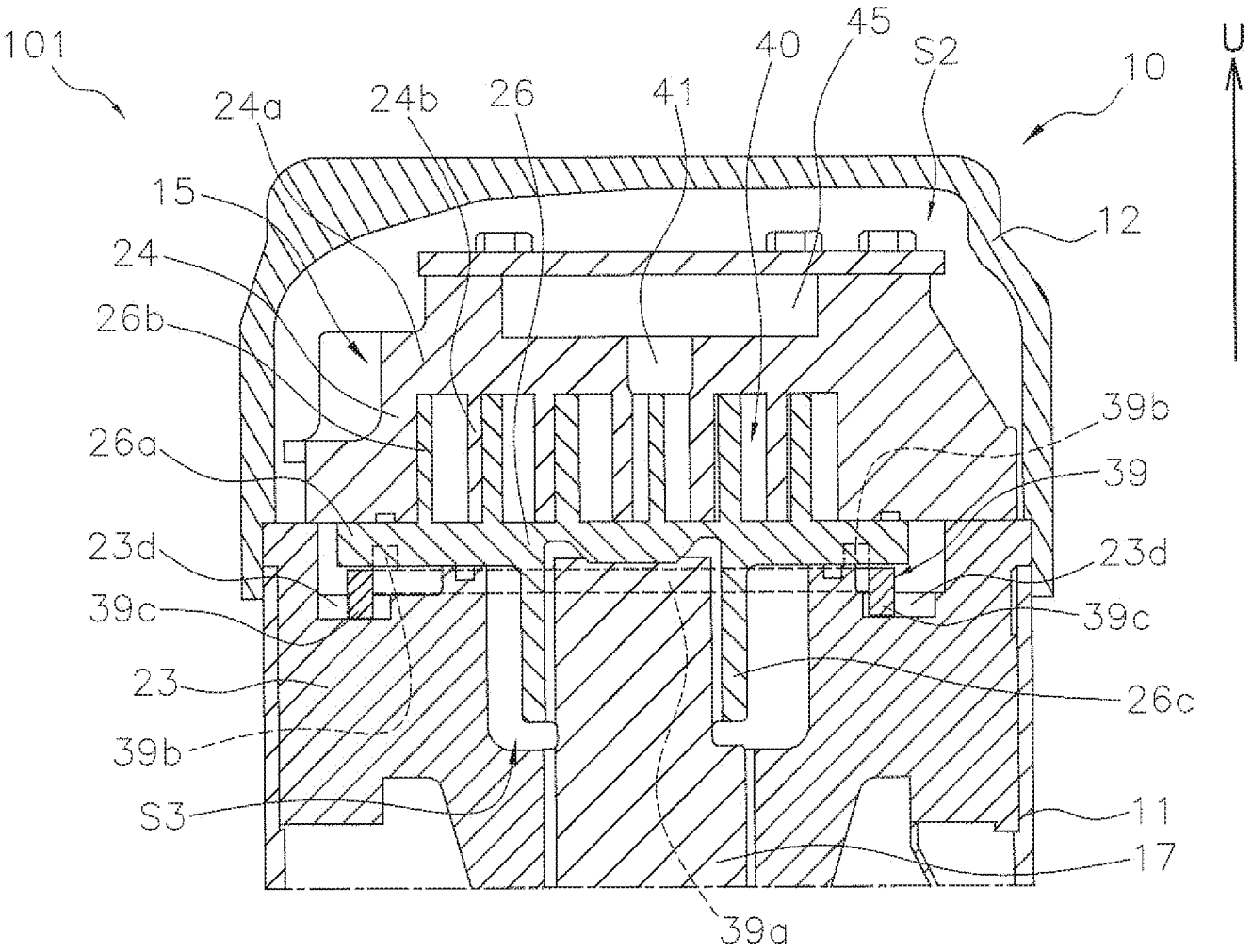
FIG. 6 is a sectional view along line segment VI-VI of FIG. 5.
Figure 7:
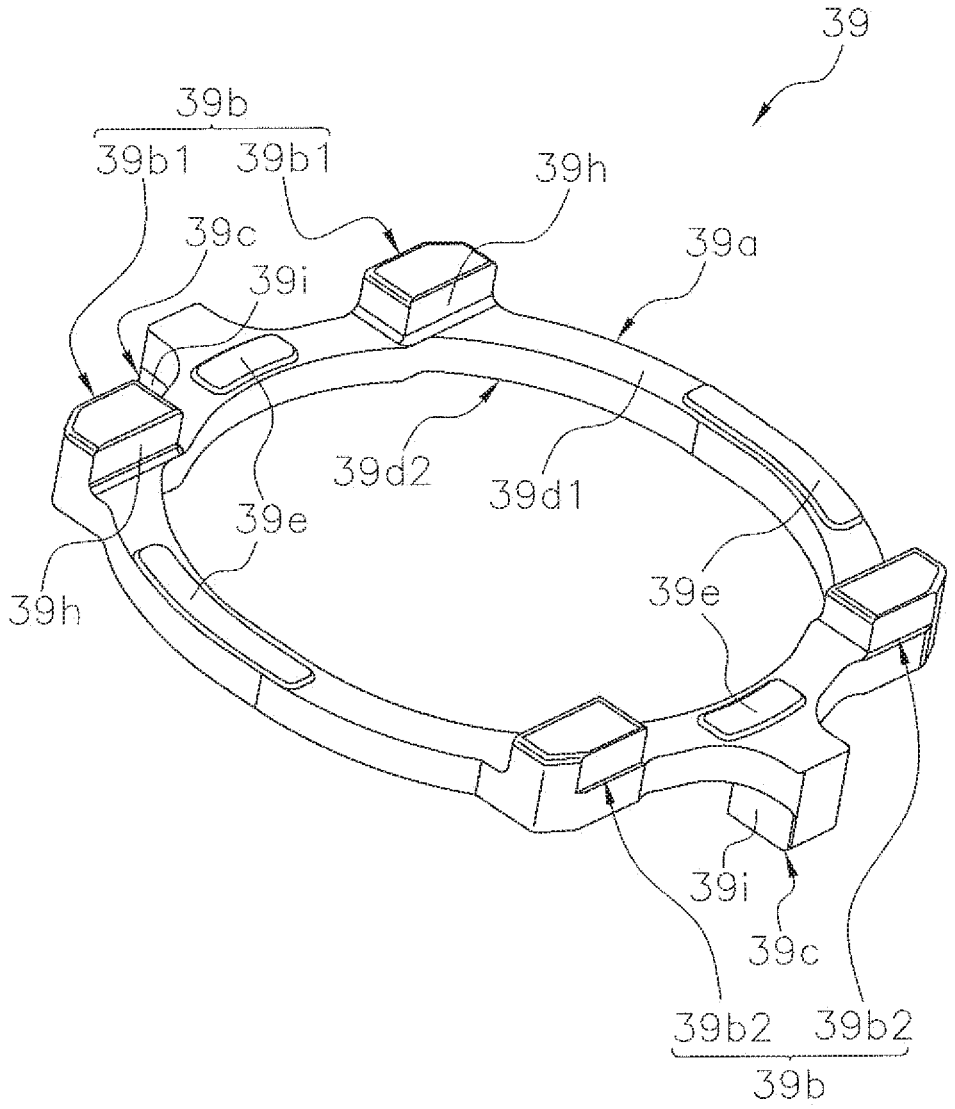
FIG. 7 is a perspective view of the Oldham coupling.
Figure 8:
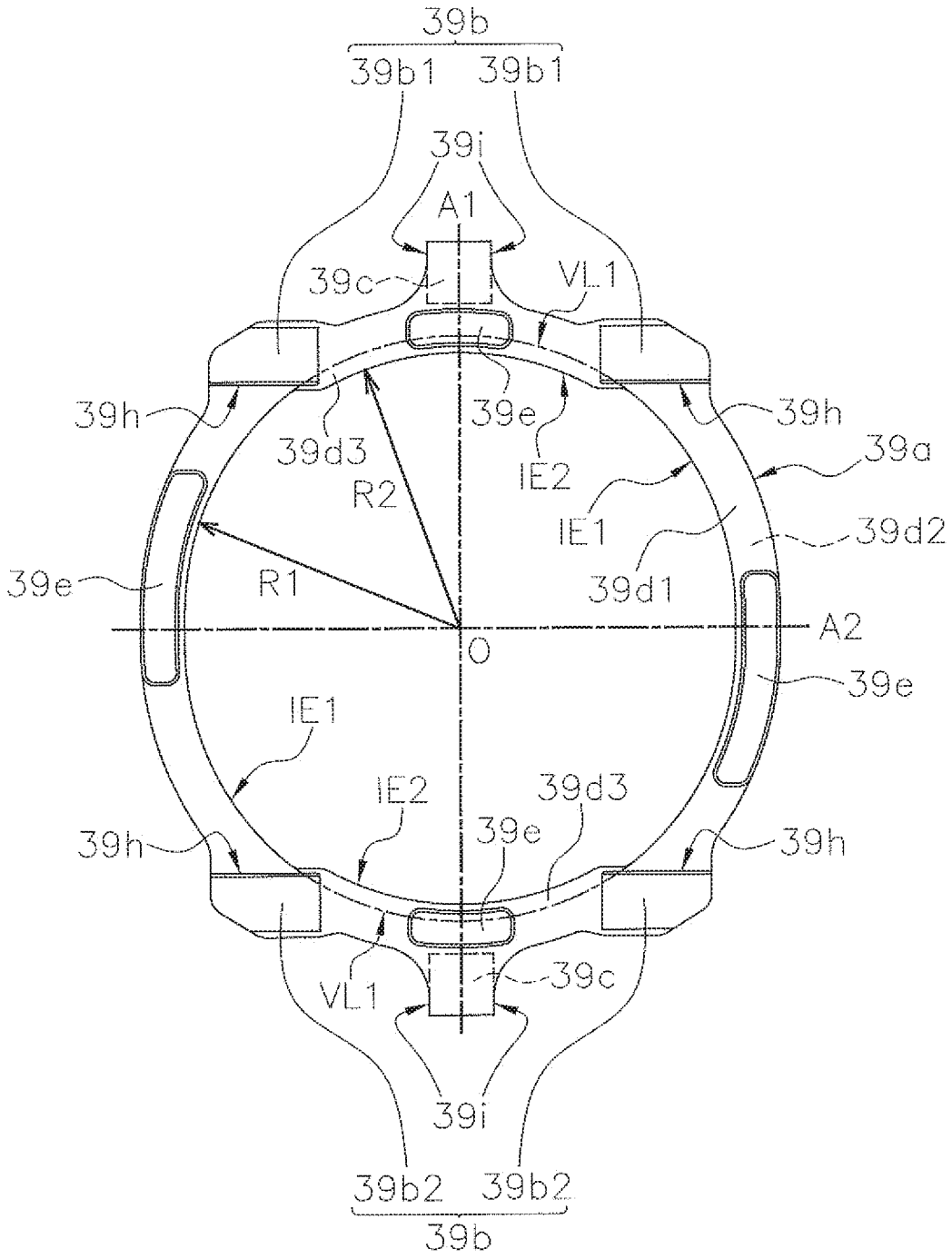
FIG. 8 is a top view of the Oldham coupling.

The Oldham coupling 39 is a member for preventing self-rotation of the orbiting movable scroll 26. FIG. 5 is an enlarged view of the area around the Oldham coupling 39 of FIG. 1. FIG. 6 is a sectional view along line segment VI-VI of FIG. 5. As shown in FIGS. 5 and 6, the Oldham coupling 39 is installed between the movable scroll 26 and the housing 23, FIG. 7 is a perspective view of the Oldham coupling 39. FIG. 8 is a top view of the Oldham coupling 39.

The Oldham coupling 39 is an annular member having mainly an annular body portion 39*a*, two pairs of first key portions 39*b*, and a pair of second key portions 39*c*.

The annular body portion 39*a* has a first horizontal surface 39*d*1 and a second horizontal surface 39*d*2 that oppose each other. The first horizontal surface 39*d*1 and the second horizontal surface 39*d*2 are surfaces parallel to the horizontal plane. The first horizontal surface 39*d*1 is positioned higher than the second horizontal surface 39*d*2. In FIGS. 7 and 8, the second horizontal surface 39*d*2 is a surface on the reverse side of the first horizontal surface 39*d*1. On the first horizontal surface 39*d*1 are formed plural sliding raised portions 39*e*. The upper surfaces of the sliding raised portions 39*e* are parallel to the first horizontal surface 39*d*1.

The first key portions 39*b* are raised portions that project upward from the first horizontal surface 39*d*1. The first key portions 39*b* are fitted into the first key grooves 26*d* of the movable scroll 26.

The second key portions 39*c* are raised portions that project downward from the second horizontal surface 39*d*2. The second key portions 39*c* are fitted into the second key grooves 23*d* of the housing 23. In FIG. 8, the positions of the second key portions 39*c* are indicated by dashed lines.

FIG. 8 shows a first axis A1 and a second axis A2 that are parallel to the horizontal plane. The first axis A1 and the second axis A2 pass through a center of gravity O of the Oldham coupling 39 and are orthogonal to each other. The four first key portions 39*b* are formed one each in four regions partitioned by the first axis A1 and the second axis A2. The two second key portions are formed one each in two regions partitioned by the second axis A2. Hereinafter, as needed, the four first key portions 39*b* will be differentiated into a pair of first key portions 39*b*1 and a pair of first key portions 39*b*2 and described as shown in FIG. 7 and FIG. 8.

The pair of first key portions 39*b*1 are formed in symmetrical positions across the first axis A1. The pair of first key portions 39*b*2 are formed in symmetrical positions across the first axis A1. The pair of first key portions 39*b*1 and the pair of first key portions 39*b*2 are formed in symmetrical positions across the second axis A2. The pair of second key portions 39*c* are formed in symmetrical positions across the second axis A2. Each second key portion 39*c* is formed in a position on the first axis A1 in which it is symmetrical with respect to the first axis A1.

The first key portions 39*b* have first sliding surfaces 39*h* that are side surfaces parallel to the second axis A2. The first sliding surfaces 39*h* are the surfaces closer to the center of gravity O of the Oldham coupling 39 among the two side surfaces of each first key portion 39*b* that are parallel to the second axis A2. The first sliding surfaces 391*i* are surfaces that slide against the inner surfaces of the first key grooves 26*d* along the second axis A2. The first sliding surfaces 39*h* are surfaces that receive surface pressure from the movable scroll 26.

The second key portions 39*c* have second sliding surfaces 39*i* that are side surfaces parallel to the first axis A1. The second sliding surfaces 39*i* are the two side surfaces of each second key portion 39*c* that are parallel to the first axis A1. The second sliding surfaces 39*i* are surfaces that slide against the inner surfaces of the second key grooves 23*d* along the first axis A1. The second sliding surfaces 39*i* are surfaces that receive surface pressure from the housing 23.

The Oldham coupling 39 is relatively movable with respect to the housing 23 along the first axis A1 and is relatively movable with respect to the movable scroll 26 along the second axis A2. As the Oldham coupling 39 relatively moves with respect to the movable scroll 26, the upper surfaces of the sliding raised portions 39*e* of the Oldham coupling 39 slide against the lower surface of the second end plate 26*a* of the movable scroll 26.

In FIG. 8 are shown first inner peripheral edges IE1 and second inner peripheral edges IE2 that are inner peripheral edges of the annular body portion 39*a* when the Oldham coupling 39 is seen along the vertical direction. The first inner peripheral edges IE1 and the second inner peripheral edges IE2 correspond to inner peripheral surfaces of the annular body portion 39*a*. When the Oldham coupling 39 is seen along the vertical direction, the first inner peripheral edges IE1 and the second inner peripheral edges IE2 have circular arc shapes.

The first inner peripheral edges IE1 are inner peripheral edges of the annular body portion 39*a* between the two first key portions 39*b* located on the same sides with respect to the first axis A1. The second inner peripheral edges IE2 are inner peripheral edges of the annular body portion 39*a* between the two key portions 39*h* located on the same sides with respect to the second axis A2. In the radial direction of the annular body portion 39*a*, the first inner peripheral edges IE1 are positioned more outward in the radial direction than the second inner peripheral edges IE2. That is, as shown in FIG. 8, a first inner peripheral radius R1 that is the radius of the circular arcs of the first inner peripheral edges IE1 is longer than a second inner peripheral radius R2 that is the radius of the circular arcs of the second inner peripheral edges IE2.

In FIG. 8, virtual extension lines VL1 of the first inner peripheral edges IE1 are indicated by long-dashed short-dashed lines. The virtual extension lines VL1 are virtual circular arcs in which the circular arcs forming the first inner peripheral edges IE1 in FIG. 8 are extended from both ends of the first inner peripheral edges IE1. The first inner peripheral radius R1 is longer than the second inner peripheral radius R2, so in the radial direction of the annular body portion 39*a* the virtual extension lines VL1 are positioned more outward in the radial direction than the second inner peripheral edges IE2.

Figure 9:
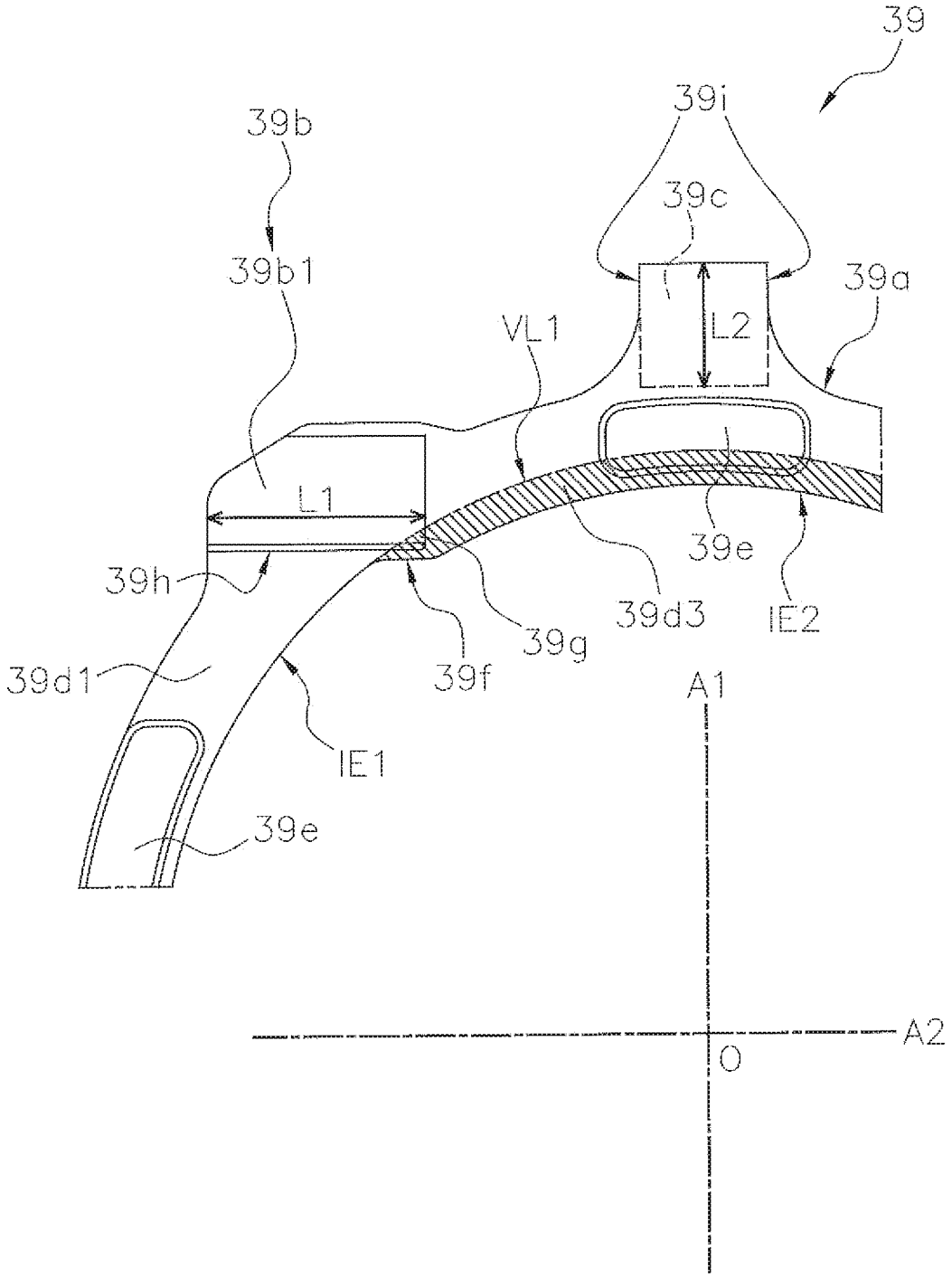

FIG. 9 is an enlarged view of the area around the first key portion 39*b* at the upper left of FIG. 8. Hereinafter, the regions that are part of the first horizontal surface 39*d*1 and are located between the virtual extension lines VL1 and the second inner peripheral edges IE2 as shown in FIGS. 8 and 9 will be called inwardly positioned surfaces 39*d*3. The inwardly positioned surfaces 39*d*3 are surfaces positioned more on the center of gravity O side of the Oldham coupling 39 than the virtual extension lines VL1. In FIG. 9, the inwardly positioned surface 39*d*3 is indicated as a region with hatching.

As shown in FIG. 9, the first key portions 39*b* have inwardly positioned portions 39*g* that project upward from the inwardly positioned surfaces 39*d*3 of the first horizontal surface 39*d*1. That is, the first key portions 39*h* have inwardly positioned portions 39*g* that are positioned more on the center of gravity O side of the Oldham coupling 39 than the virtual extension lines VL1.

As shown in FIG. 9, a dimension L1 of the first key portions 39*b* along the second axis A2 is longer than a dimension L2 of the second key portions 39*c* along the first axis A1. That is, a first sliding length L1 that is the sliding direction dimension of the first sliding surfaces 39*h* is longer than a second sliding length L2 that is the sliding direction dimension of the second sliding surfaces 39*i*.

As shown in FIG. 9, the first inner peripheral edges IE1 and the second inner peripheral edges IE2 are interconnected via step portions 39*f*. The step portions 39*f* correspond to inner peripheral edges of the annular body portion 39*a* that interconnect the first inner peripheral edges IE1 and the second inner peripheral edges IE2. The step portions 39*f* are parallel to the first sliding surfaces 39*h* of the first key portions 39*b*.

(1-5) Drive Motor

The drive motor 16 is a brushless DC motor disposed under the housing 23. The drive motor 16 has mainly a stator 51 and a rotor 52. The stator 51 is an open cylinder-shaped member fixed to the inner peripheral surface of the casing 10. The rotor 52 is a solid cylinder-shaped member disposed inside the stator 51. An air gap is formed between the inner peripheral surface of the stator 51 and the outer peripheral surface of the rotor 52. Plural core cuts are formed in the outer peripheral surface of the stator 51. The core cuts are grooves formed in the vertical direction ranging from the upper end surface to the lower end surface of the stator 51. The core cuts are formed at predetermined intervals along the circumferential direction of the stator 51. The core cuts form motor cooling passageways 55 that extend in the vertical direction between the barrel casing portion 11 and the stator 51.

The rotor 52 is coupled to the crankshaft 17. The crankshaft 17 runs in the vertical direction through the rotational center of the rotor 52. The rotor 52 is connected via the crankshaft 17 to the compression mechanism 15.

(1-6) Lower Bearing

The lower bearing 60 is disposed under the drive motor 16. The outer peripheral surface of the lower hearing 60 is airtightly joined to the inner peripheral surface of the casing 10. The lower bearing 60 supports the crankshaft 17. An oil separation plate 73 is attached to the lower bearing 60. The oil separation plate 73 is a fiat plate-shaped member housed inside the casing 10. The oil separation plate 73 is fixed to the upper end surface of the lower bearing 60.

(1-7) Crankshaft

The crankshaft 17 is housed inside the casing 10. The crankshaft 17 is disposed in such a way that its axial direction lies along the vertical direction. The axial center of the upper end portion of the crankshaft 17 is slightly eccentric with respect to the axial center of the portion excluding the upper end portion. The crankshaft 17 has a counterweight 18. The counterweight 18 is tightly fixed to the crankshaft 17 at a height position under the housing 23 and above the drive motor 16.

The crankshaft 17 runs in the vertical direction through the rotational center of the rotor 52 and is coupled to the rotor 52. The upper end portion of the crankshaft 17 is fitted into the upper end bearing 26*c*, whereby the crankshaft 17 is connected to the movable scroll 26. The crankshaft 17 is supported by the upper bearing 32 and the lower bearing 60.

The crankshaft 17 has inside a main oil feed passage 61 that extends in the axial direction of the crankshaft 17. The upper end of the main oil feed passage 61 communicates with an oil chamber 83 formed by the upper end surface of the crankshaft 17 and the lower surface of the second end plate 26*a*. The oil chamber 83 communicates with the thrust sliding surface 24*d* and the oil groove 24*e* via the oil feed pore 63 in the second end plate 26*a* and finally communicates with the low-pressure space S2 via the compression chambers 40. The lower end of the main oil feed passage 61 is immersed in the lubricating oil in the oil collection space 10*a*.

The crankshaft 17 has a first auxiliary oil feed passage 61*a*, a second auxiliary oil feed passage 61*b*, and a third auxiliary oil feed passage 61*c* that branch from the main oil feed passage 61. The first auxiliary oil feed passage 61*a*, the second auxiliary oil feed passage 61*b*, and the third auxiliary oil feed passage 61*c* extend in the horizontal direction. The first auxiliary oil feed passage 61*a* opens to the sliding surfaces of the crankshaft 17 and the upper end bearing 26*c* of the movable scroll 26. The second auxiliary oil feed passage 61*b* opens to the sliding surfaces of the crankshaft 17 and the upper bearing 32 of the housing 23. The third auxiliary oil feed passage 61*b* opens to the sliding surfaces of the crankshaft 17 and the lower bearing 60.

(1-8) Suction Pipe

The suction pipe 19 is a pipe for introducing the refrigerant in the refrigerant circuit from the outside of the casing 10 to the compression mechanism 15. The suction pipe 19 is airtightly fitted into the top wall portion 12 of the casing 10. The suction pipe 19 runs in the vertical direction through the upper space S2, and its inner end portion is fitted into the main suction hole 24*c* in the fixed scroll 24.

(1-9) Discharge Pipe

The discharge pipe 20 is a pipe for discharging the compressed refrigerant from the high-pressure space S1 to the outside of the casing 10. The discharge pipe 20 is airtightly fitted into the barrel casing portion 11 of the casing 10. The discharge pipe 20 runs in the horizontal direction through the high-pressure space S1. Inside the casing 10, an open portion 20*a* of the discharge pipe 20 is positioned in the neighborhood of the housing 23.

(2) Operation of Scroll Compressor

The operation of the scroll compressor 101 will be described. First, the flow of the refrigerant circulating through the refrigerant circuit equipped with the scroll compressor 101 will be described. Next, the flow of the lubricating oil inside the scroll compressor 101 will be described.

(2-1) Flow of Refrigerant

When the driving of the drive motor 16 starts, the rotor 52 begins to rotate and the crankshaft 17 fixed to the rotor 52 begins axially rotating. The axial rotational movement of the crankshaft 17 is transmitted via the upper end bearing 26*c* to the movable scroll 26. The axial center of the upper end portion of the crankshaft 17 is eccentric with respect to the axial center of the axial rotational movement of the crankshaft 17.

The movable scroll 26 is engaged with the housing 23 via the Oldham coupling 39. When the crankshaft 17 rotates, the first key portions 39*b* of the Oldham coupling 39 slide along the second axis A2 inside the first key grooves 26*d* of the movable scroll 26, and the second key portions 39*c* of the Oldham coupling 39 slide along the first axis A1 inside the second key grooves 23*d* of the housing 23. Because of this, the movable scroll 26 performs orbiting movement with respect to the fixed scroll 24 without self-rotating.

The low-temperature low-pressure refrigerant before being compressed is supplied from the suction pipe 19 via the main suction hole 24*c* to the compression chambers 40 of the compression mechanism 15. Because of the orbiting movement of the movable scroll 26, the compression chambers 40 move from the outer peripheral portion to the central portion of the fixed scroll 24 while their volumes are gradually decreased. As a result, the refrigerant in the compression chambers 40 is compressed and becomes compressed refrigerant. The compressed refrigerant is discharged from the discharge hole 41 to the muffler space 45 and thereafter is discharged via the first compressed refrigerant flow passage 46 and the second compressed refrigerant flow passage 48 to the high-pressure space S1. Thereafter, the compressed refrigerant descends through a motor cooling passageway 55 and reaches the high-pressure space S1 under the drive motor 16. Thereafter, the compressed refrigerant reverses its flow direction and ascends through another motor cooling passageway 55 and the air gap in the drive motor 16. Finally, the compressed refrigerant is discharged from the discharge pipe 20 to the outside of the scroll compressor 101.

(2-2) Flow of Lubricating Oil

When the driving of the drive motor 16 starts, the rotor 52 begins to rotate and the crankshaft 17 fixed to the rotor 52 begins axially rotating. When the compression mechanism 15 is driven by the axial rotation of the crankshaft 17 and the compressed refrigerant is discharged to the high-pressure space S1. the pressure inside the high-pressure space S1 increases. The lower end of the main oil feed passage 61 communicates with the oil collection space 10*a* inside the high-pressure space S1. The upper end of the main oil feed passage 61 communicates with the low-pressure space S2 via the oil chamber 83 and the oil feed pore 63. Because of this, differential pressure occurs between the upper end and the lower end of the main oil feed passage 61. As a result, the lubricating oil stored in the oil collection space 10*a* is sucked by the differential pressure from the lower end of the main oil feed passage 61 and ascends through the inside of the main oil feed passage 61 to the oil chamber 83.

Most of the lubricating oil ascending through the main oil feed passage 61 is sequentially distributed to the third auxiliary oil feed passage 61*c*, the second auxiliary oil feed passage 61*b*, and the first auxiliary oil feed passage 61*a*. The lubricating oil flowing through the third auxiliary oil feed passage 61*c* lubricates the sliding surfaces of the crankshaft 17 and the lower bearing 60 and thereafter flows into the high-pressure space S and returns to the oil collection space 10*a*. The lubricating oil flowing through the second auxiliary oil feed passage 61*b* lubricates the sliding surfaces of the crankshaft 17 and the upper bearing 32 of the housing 23 and thereafter flows into the high-pressure space S1 and the crank chamber S3. The lubricating oil that has flowed into the high-pressure space S1 returns to the oil collection space 10*a*. The lubricating oil that has flowed into the crank chamber S3 flows via the oil return passageway 23*a* in the housing 23 to the high-pressure space S1 and returns to the oil collection space 10*a*. The lubricating oil flowing through the first auxiliary oil feed passage 61*a* lubricates the sliding surfaces of the crankshaft 17 and the upper end bearing 26*c* of the movable scroll 26 and thereafter flows into the crank chamber S3 and returns via the high-pressure space S1 to the oil collection space 10*a*.

The lubricating oil that has ascended through the inside of the main oil feed passage 61 to the upper end and has reached the oil chamber 83 flows through the oil feed pore 63 and is supplied to the oil groove 24*e* by the differential pressure. Some of the lubricating oil that has been supplied to the oil groove 24*e* leaks out to the low-pressure space S2 and the compression chambers 40 while sealing the thrust sliding surface 24*d*. At this time, the high-temperature lubricating oil that has leaked out heats the low-temperature refrigerant gas present in the low-pressure space S2 and the compression chambers 40. Furthermore, the lubricating oil that has leaked out to the compression chambers 40 becomes mixed in, as minute oil droplets, with the compressed refrigerant. The lubricating oil that has been mixed in with the compressed refrigerant travels the same path as the compressed refrigerant and is discharged from the compression chambers 40 to the high-pressure space S1. Thereafter, the lubricating oil descends together with the compressed refrigerant through the motor cooling passageways 55 and thereafter hits the oil separation plate 73. The lubricating oil sticking to the oil separation plate 73 falls through the high-pressure space S and returns to the oil collection space 10*a*.

(3) Characteristics of Scroll Compressor

In the scroll compressor 101, the Oldham coupling 39 has the first key portions 39*b* that slide against the movable scroll 26 and the second key portions 39*c* that slide against the housing 23. The first key portions 39*b* have the first sliding surfaces 39*h* that slide along the second axis A2 against the inner surfaces of the first key grooves 26*d* of the movable scroll 26. When the Oldham coupling 39 is seen along the vertical direction, as shown in FIGS. 8 and 9, the first inner peripheral edges IE1 of the Oldham coupling 39 are positioned more outward in the radial direction than the second inner peripheral edges IE2. Additionally, the first key portions 39*b* have the inwardly positioned portions 39*g* that are positioned more on the center of gravity O side of the Oldham coupling 39 than the virtual extension lines VL1 of the first inner peripheral edges IE1. For that reason, the first sliding length L1 that is the sliding direction dimension of the first sliding surfaces 39*h* can be lengthened an amount corresponding to the inwardly positioned portions 39*g* of the first key portions 39*b*.

The sliding length of the key portions of an Oldham coupling is constrained by the dimensions of the Oldham coupling specifically, the radial direction dimension of the annular body portion of the Oldham coupling. In the conventional Oldham coupling, the key portions corresponding to the first key portions 39*b* of the embodiment do not have portions corresponding to the inwardly positioned portions 39*g*. For that reason, in the conventional Oldham coupling, sometimes the sliding length of the key portions cannot be sufficiently ensured. When the sliding length of the key portions is not sufficient, there is the concern that the surface pressure that acts on the sliding surfaces of the key portions will become higher and that issues such as seizure of the sliding surfaces and damage to the key portions will arise, thereby reducing the reliability of the compressor.

In contrast, the Oldham coupling 39 of the scroll compressor 101 of the embodiment can sufficiently ensure, with the inwardly positioned portions 39*g* of the first key portions 39*b*, the first sliding length L1 of the first key portions 39*b*.

Because of this, the surface pressure that acts on the first sliding surfaces 39*h* of the first key portions 39*b* from the movable scroll 26 is restrained, For that reason, the occurrence of issues such as seizure of the first sliding surfaces 39*h* of the first key portions 39*b* and damage to the first key portions 39*b* is inhibited. Consequently, the scroll compressor 101 has high reliability by sufficiently ensuring the first sliding length L1 of the first key portions 39*b* of the Oldham coupling 39.

Furthermore, the annular body portion 39*a* of the Oldham coupling 39 has the first inner peripheral edges IE1 and the second inner peripheral edges IE2 that have circular arc shapes with mutually different radii when seen along the vertical direction. The first inner peripheral edges IE1 and the second inner peripheral edges IE2 form the step portions 39*f* at the positions of the inwardly positioned portions 39*g* of the first key portions 39*b*. Because of the step portions 39*f*, the first inner peripheral edges IE1 are formed more outward in the radial direction of the annular body portion 39*a* than the second inner peripheral edges IE2. For that reason, the radial direction dimension of the annular body portion 39*a* can be shortened in the ranges of the first inner peripheral edges IE1 in the circumferential direction of the annular body portion 39*a*. Consequently, with the scroll compressor 101, the weight of the Oldham coupling 39 can be reduced.

Furthermore, by forming, the second inner peripheral edges IE2 more inward in the radial direction of the annular body portion 39*a* than the first inner peripheral edges IE1, the radial direction dimension of the annular body portion 39*a* can be ensured in the ranges of the second inner peripheral edges IE2 in the circumferential direction of the annular body portion 39*a*. Because of this, the second sliding length L2 of the second key portions 39*c* can be lengthened. For that reason, the occurrence of issues such as seizure of the second sliding surfaces 39*i* of the second key portions 39*c* and damage to the second key portions 39*c* is inhibited.

(4) Example Modifications

An embodiment of the invention has been described above, but the specific configurations of the invention can be changed in a range that does not depart from the spirit of the invention. Example modifications applicable to the embodiment of the invention will be described below.

(4-1) Example Modification A

In the embodiment, the movable scroll 26 has the first key grooves 26*d* that slide against the first key portions 39*b* of the Oldham coupling 39. The first sliding surfaces 39*h* of the first key portions 39*b* slide against the inner surfaces of the first key grooves 26*d*. However, the movable scroll 26 may also have, instead of the first key grooves 26*d*, cutouts having surfaces that slide against the first sliding surfaces 39*h* of the first key portions 39*b*.

(4-2) Example Modification B

In the embodiment, the first sliding length L1 that is the sliding direction dimension of the first sliding surfaces 39*h* is longer than the second sliding length L2 that is the sliding direction dimension of the second sliding surfaces 39*i*. However, the first sliding length L1 does not need to be longer than the second sliding length L2 as long as the first sliding length L1 and the second sliding length L2 are sufficiently ensured.

(4-3) Example Modification C

In the embodiment, when the Oldham coupling 39 is seen along the vertical direction, the inner peripheral surface of the annular body portion 39*a* has a circular arc shape. FIG. 3 shows the first inner peripheral edges IE1 and the second inner peripheral edges IE2 that are the inner peripheral edges of the annular body portion 39*a* when the Oldham coupling 39 of the embodiment is seen along the vertical direction. When the Oldham coupling 39 is seen along the vertical direction, the first inner peripheral edges IE1 and the second inner peripheral edges IE2 have circular arc shapes.

However, the inner peripheral surface of the annular body portion 39*a* may also have an arbitrary shape. Specifically, the second inner peripheral edges IE2 do not need to have circular arc shapes as long as the first key portions 39*b* have the inwardly positioned portions 39*g*. Here, the inwardly positioned portions 39*g* are, as shown in FIG. 9, portions that are part of the first key portions 39*b* and are positioned more on the center of gravity O side of the Oldham coupling 39 than the virtual extension lines VL1 of the first inner peripheral edges IE1.

Figure 10:
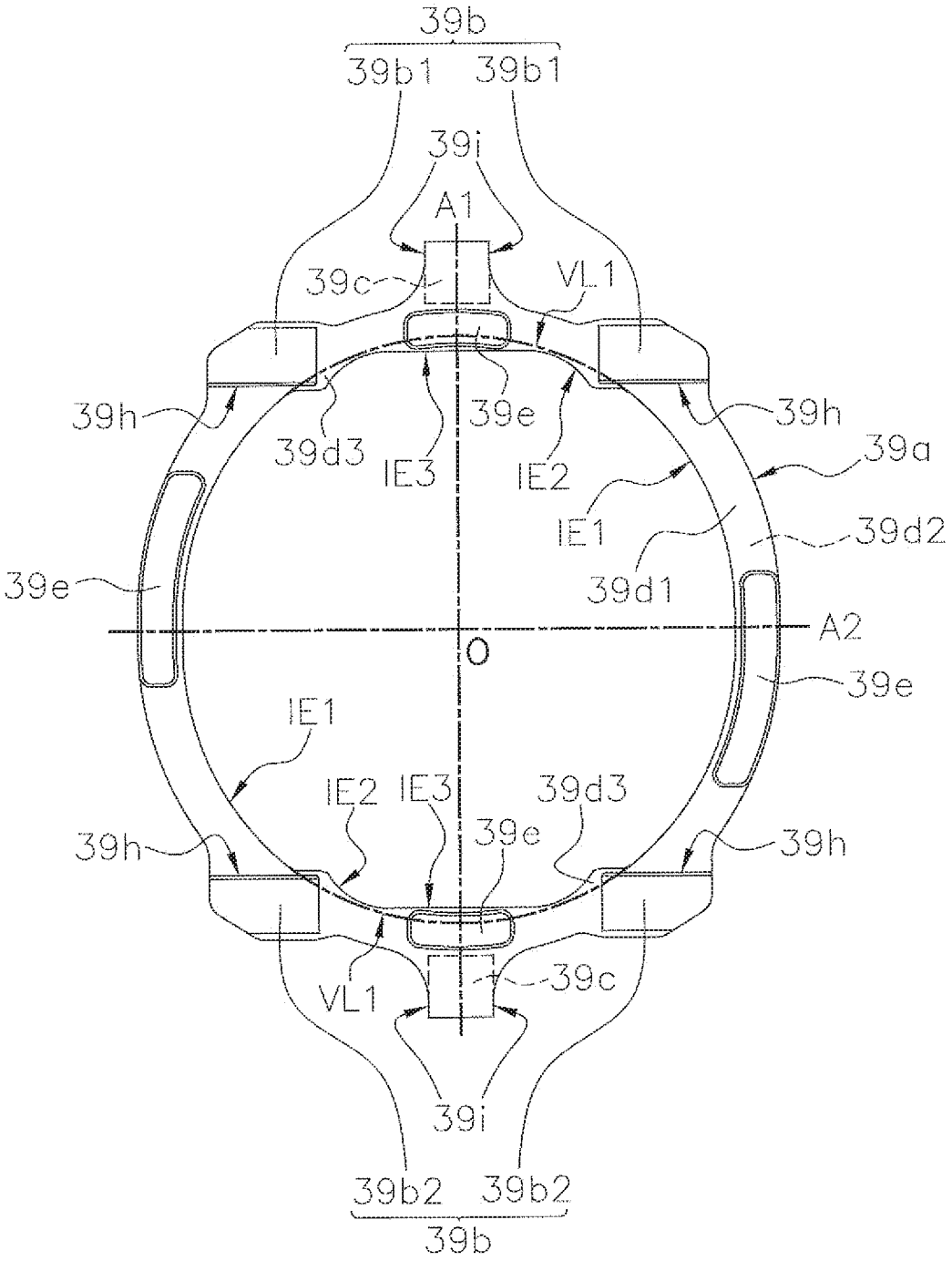
FIG. 10 is a top view of the Oldham coupling 39 of example modification C.
Figure 11:
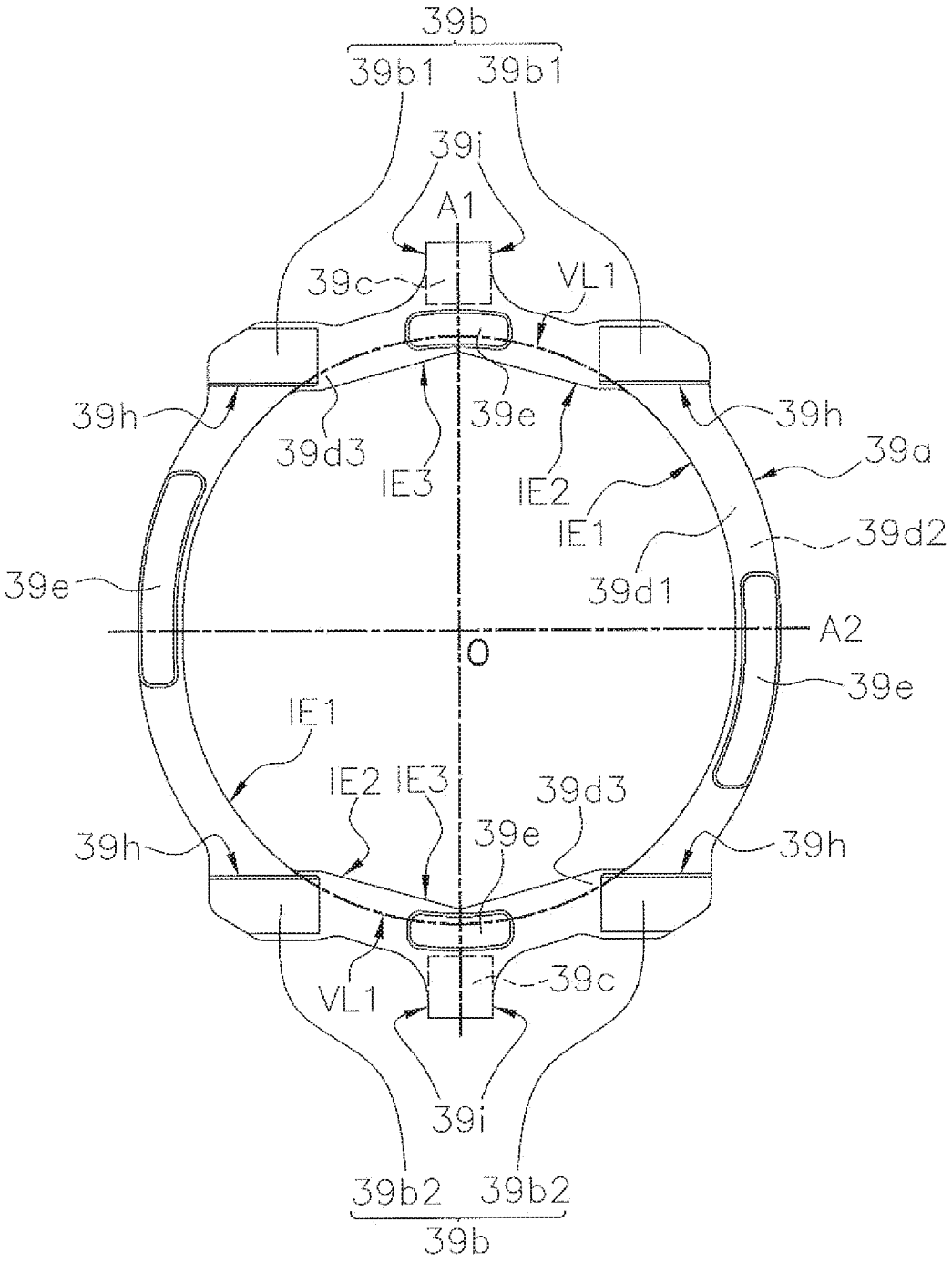
FIG. 11 is a top view of the Oldham coupling 39 of example modification C.

FIG. 10 and FIG. 11 are top views of the Oldham coupling 39 of the present example modification. In FIG. 10, the second inner peripheral edges IE2 positioned between the pair of first key portions 39*b*1 and between the pair of first key portions 39*b*2 include linear portions IE3 that are parallel to the second axis A2. In FIG. 11, the second inner peripheral edges IE2 positioned between the pair of first key portions 39*b*1 and between the pair of first key portions 39*b*2 include linear portions IE3 that are not parallel to the second axis A2. In FIG. 10 and FIG. 11, when the Oldham coupling 39 is seen along the vertical direction, the second inner peripheral edges IE2 are positioned more on the center of gravity O side of the Oldham coupling 39 than the virtual extension lines VL1 of the first inner peripheral edges IE1.

In this example modification also, the first sliding length L1 that is the sliding direction dimension of the first sliding surfaces 39*h* can be lengthened an amount corresponding to the inwardly positioned portions 39*g* of the first key portions 39*b*. Because of this, the surface pressure that acts on the first sliding surfaces 39*h* of the first key portions 39*b* from the movable scroll 26 is restrained. For that reason, the occurrence of issues such as of seizure of the first sliding surfaces 39*h* of the first key portions 39*b* and damage to the first key portions 39*b* is inhibited.

(4-4) Example Modification D

In the embodiment, as shown in FIG. 8, the Oldham coupling 39 has mainly the annular body portion 39*a*, the two pairs of first key portions 39*b*, and the pair of second key portions 39*c*. The two pairs of first key portions 39*h* comprise the pair of first key portions 39*b*1 and the pair of first key portions 39*b*2. The pair of first key portions 39*b* 1 are formed in symmetrical positions across the first axis A1. The pair of first key portions 39*b*2 are famed in symmetrical positions across the first axis A1. The pair of first key portions 39*b*1 and the pair of first key portions 39*b*2 are formed in symmetrical positions across the second axis A2.

However, the Oldham coupling 39 may also, instead of having the two pairs of first key portions 39*b*, have just one of the pair of first key portions 39*b*1 and just one of the pair of first key portions 39*b*2. That is, the first key portions 39*b* of the Oldham coupling 39 may be configured from just one first key portion 39*b*1 and one first key portion 39*b*2.

Figure 12:
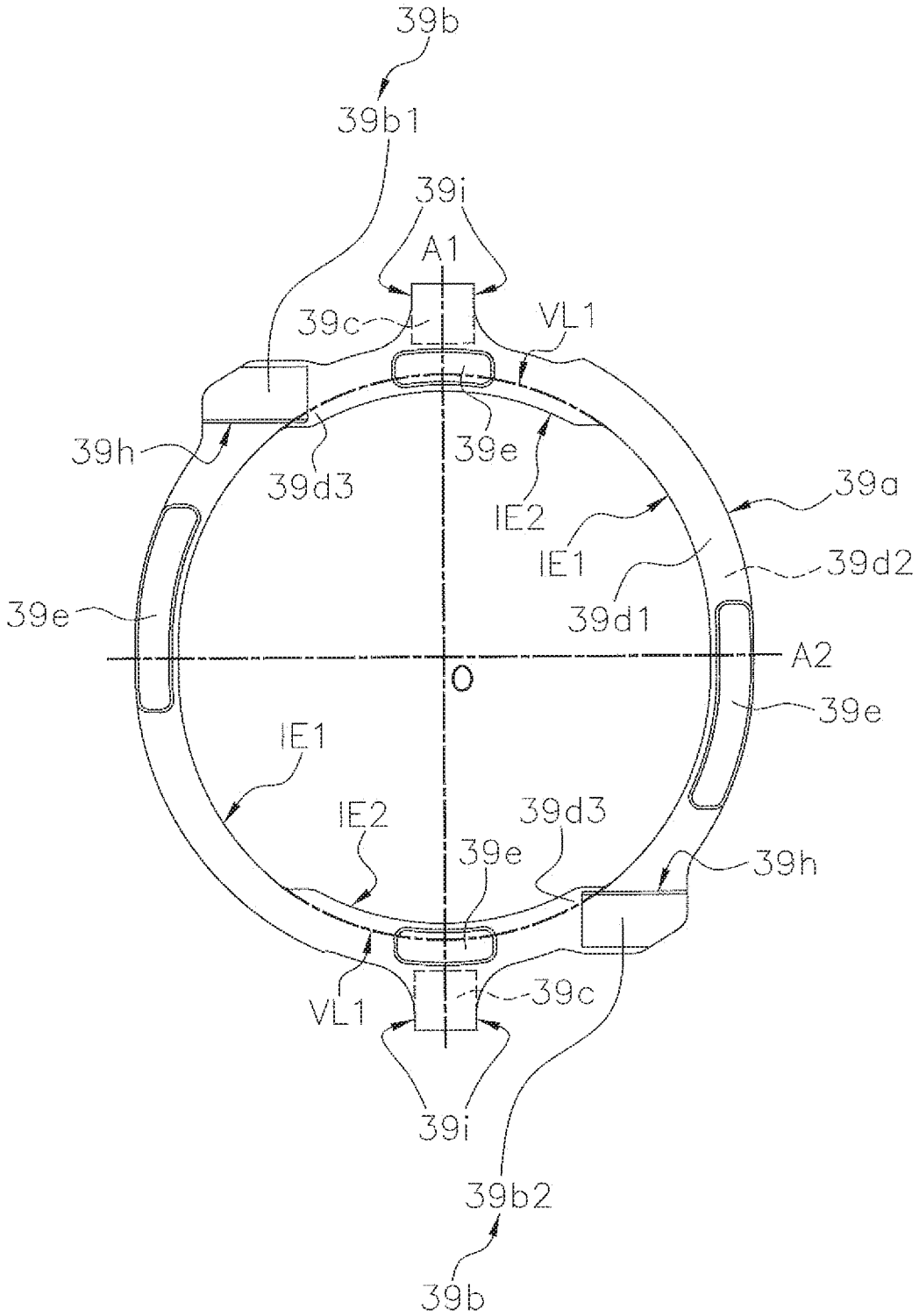
FIG. 12 is a top view of the Oldham coupling 39 of example modification D.
Figure 13:
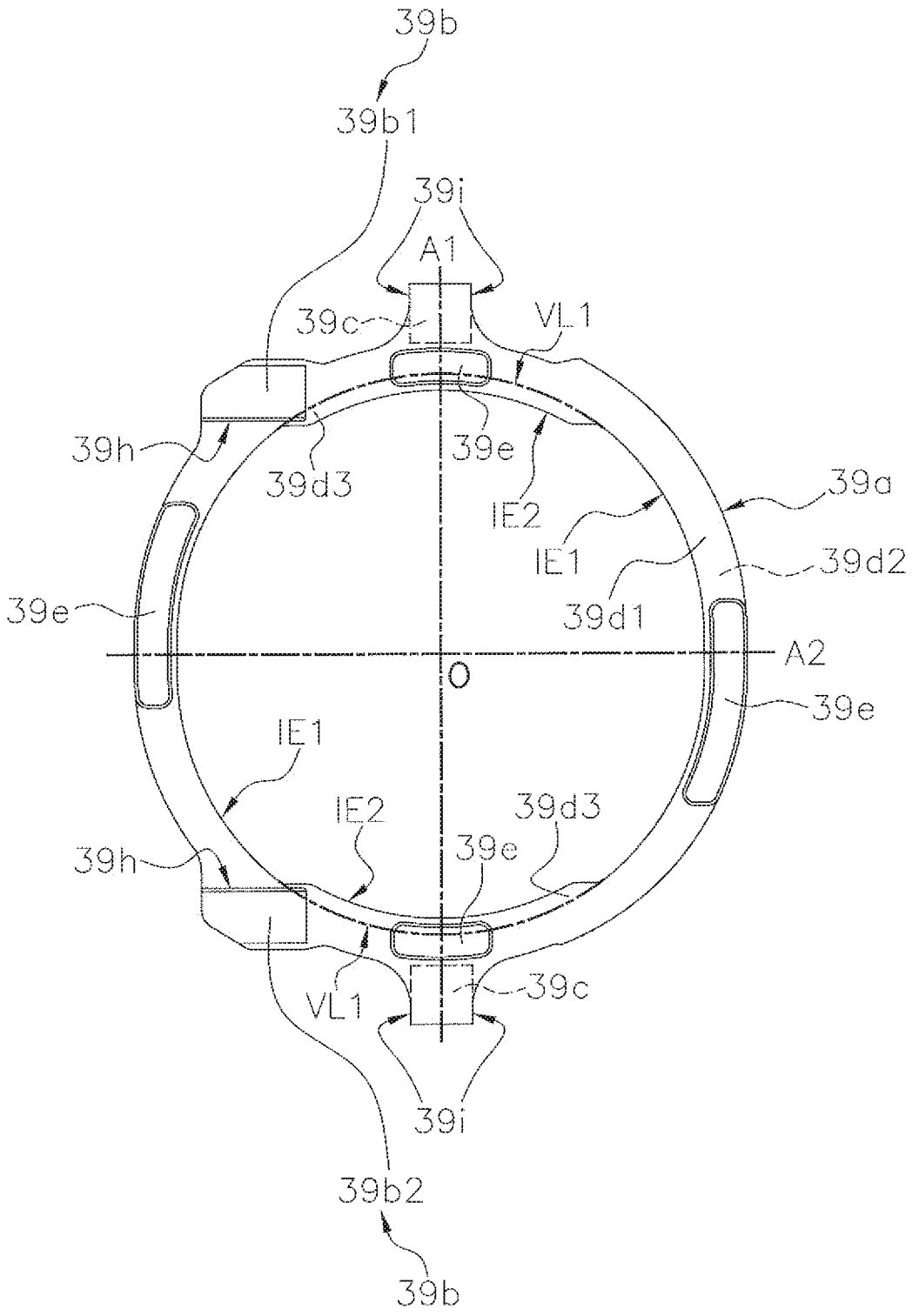
FIG. 13 is a top view of the Oldham coupling 39 of example modification D.

As examples, FIG. 12 and. FIG. 13 are top views of the Oldham coupling 39 of the present example modification. In FIG. 12 and FIG. 13, the Oldham coupling 39 has one first key portion 39*b*1 and one first key portion 39*b*2. In the Oldham coupling 39 shown in FIG. 12, the two first key portions 39*b*1 and 39*b*2 are formed in symmetrical positions with respect to the center of gravity O of the Oldham coupling 39. In the Oldham coupling 39 shown in FIG. 13, the two first key portions 39*b*1 and 39*b*2 are formed in symmetrical positions across the second axis A2. Furthermore, the two first key portions 39*b*1 and 39*b*2 may be formed in symmetrical positions across the first axis A1 from the positions shown in FIG. 12 and FIG. 13.

Furthermore, in this example modification, it suffices for the Oldham coupling 39 to have at least two first key portions 39*b* among the four first key portions 39*b* shown in FIG. 8.

That is, the Oldham coupling 39 may also have two or three first key portions 39*b*. In this case, the first key portions 39*b* are provided in any of the four regions partitioned by the first axis A1 and the second axis A2, and two or more of the first key portions 39*b* are not provided in the same region.

It will be noted that, in this example modification, as long as the first key portions 39*b* have the inwardly positioned portions 39*b*, when the Oldham coupling 39 is seen along the vertical direction the first inner peripheral edges IE1 and the second inner peripheral edges IE2 may also have arbitrary shapes as in example modification A.

INDUSTRIAL APPLICABILITY

The scroll compressor pertaining to the invention has high reliability by sufficiently ensuring the sliding lengths of key portions of an Oldham coupling.

What is claimed is:

1. A scroll compressor comprising:

a fixed scroll;

a movable scroll cooperating with the fixed scroll to form at least one compression chamber, the movable scroll having first key grooves;

a crankshaft having an eccentric portion coupled to the movable scroll to cause the movable scroll to orbit relative to the fixed scroll in response to rotation of the crankshaft;

a stationary member having second key grooves; and an Oldham coupling movably coupled between the movable scroll and the stationary member, the Oldham coupling being relatively movable with respect to the stationary member along a first axis, the Oldham coupling being relatively movable with respect to the movable scroll along a second axis, and the first axis being perpendicular to the second axis and passing through a center of gravity of the Oldham coupling, the Oldham coupling having an annular body portion having a first horizontal surface and a second horizontal surface that oppose each other, at least two first key portions that project from the first horizontal surface and are fitted into the first key grooves, and a pair of second key portions that project from the second horizontal surface and are fitted into the second key grooves, the first key portions being provided in any of four regions partitioned by the first axis and the second axis, and two or more of the first key portions not being provided in a same region, the second key portions being provided on the first axis on opposite sides of the second axis, the annular body portion having inner peripheral edges which define, when the Oldham coupling is seen along a vertical direction, first inner peripheral edges and second inner peripheral edges, and the first inner peripheral edges being positioned more outward than the second inner peripheral edges in a radial direction of the annular body portion, the first horizontal surface having inwardly positioned surfaces that form regions of the first horizontal surface located between the second inner peripheral edges and virtual extension lines of the first inner peripheral edges and that are positioned more on a center of gravity side of the Oldham coupling than the virtual extension lines of first inner peripheral edges, the first inner peripheral edges being formed as circular arcs extending between respective ends, and the virtual extension lines being formed as circular arcs on the first inner peripheral edges, the virtual extension lines being positioned between the two first inner peripheral edges in the circumferential direction, and the virtual extension lines being positioned more outward in the radial direction than the second inner peripheral edges and overlapping with the first key portions, and the first key portions having inwardly positioned portions that project from the inwardly positioned surfaces and extend along the second axis.

2. The scroll compressor according to claim 1, wherein the first inner peripheral edges and second inner peripheral edges are interconnected via step portions, the second inner peripheral edges being inner peripheral edges different from the first inner peripheral edges.

3. The scroll compressor according to claim 2, wherein the first inner peripheral edges and the second inner peripheral edges have circular arc shapes.

4. The scroll compressor according to claim 3, wherein a radius of the circular arcs of the first inner peripheral edges is longer than a radius of the circular arcs of the second inner peripheral edges.

5. The scroll compressor according to claim 4, wherein a dimension of the first key portions along the second axis is longer than a dimension of the second key portions along the first axis.

6. The scroll compressor according to claim 3, wherein a dimension of the first key portions along the second axis is longer than a dimension of the second key portions along the first axis.

7. The scroll compressor according to claim 2, wherein a dimension of the first key portions along the second axis is longer than a dimension of the second key portions along the first axis.

8. The scroll compressor according to claim 1, wherein a dimension of the first key portions along the second axis is longer than a dimension of the second key portions along the first axis.

9. A scroll compressor comprising:

a fixed scroll;

a movable scroll cooperating with the fixed scroll to form at least one compression chamber, the movable scroll having first key grooves;

a crankshaft having an eccentric portion coupled to the movable scroll to cause the movable scroll to orbit relative to the fixed scroll in response to rotation of the crankshaft;

a stationary member having second key grooves; and an Oldham coupling movably coupled between the movable scroll and the stationary member, the Oldham coupling being relatively movable with respect to the stationary member along a first axis, the Oldham coupling being relatively movable with respect to the movable scroll along a second axis, and the first axis being perpendicular to the second axis and passing through a center of gravity of the Oldham coupling, the Oldham coupling having an annular body portion having a first horizontal surface and a second horizontal surface that oppose each other, at least two first key portions that project from the first horizontal surface and are fitted into the first key grooves, and a pair of second key portions that project from the second horizontal surface and are fitted into the second key grooves, the first key portions being provided in any of four regions partitioned by the first axis and the second axis, and two or more of the first key portions not being provided in a same region, the second key portions being provided on the first axis on opposite sides of the second axis, the annular body portion having inner peripheral edges which define, when the Oldham coupling is seen along a vertical direction, first inner peripheral edges and second inner peripheral edges, and the first inner peripheral edges being positioned more outward than the second inner peripheral edges in a radial direction of the annular body portion, the first horizontal surface having inwardly positioned surfaces that form regions of the first horizontal surface located between the second inner peripheral edges and virtual extension lines of the first inner peripheral edges and that are positioned more on a center of gravity side of the Oldham coupling than the virtual extension lines of first inner peripheral edges, the first inner peripheral edges being formed as circular arcs extending between respective ends, and the virtual extension lines being formed as circular arcs and being defined as virtual extensions of the first inner peripheral edges beyond the ends of the first inner peripheral edges, the first key portions having inwardly positioned portions that project from the inwardly positioned surfaces, the Oldham coupling having two pairs of the first key portions, the first inner peripheral edges being the inner peripheral edges between the two first key portions located on same sides with respect to the first axis, and the second inner peripheral edges being the inner peripheral edges between the two first key portions located on same sides with respect to the second axis.

10. The scroll compressor according to claim 9, wherein the first inner peripheral edges and the second inner peripheral edges have circular arc shapes.

11. The scroll compressor according to claim 10, wherein a radius of the circular arcs of the first inner peripheral edges is longer than a radius of the circular arcs of the second inner peripheral edges.

12. The scroll compressor according to claim 9, wherein a dimension of the first key portions along the second axis is longer than a dimension of the second key portions along the first axis.

* * * * *